US011300092B2

(12) United States Patent
Osawa et al.

(10) Patent No.: US 11,300,092 B2
(45) Date of Patent: Apr. 12, 2022

(54) IGNITION COIL CONTROL DEVICE

(71) Applicant: HONDA MOTOR CO., LTD., Tokyo (JP)

(72) Inventors: Toshifumi Osawa, Wako (JP); Ryohei Kitamura, Wako (JP); Nobuyuki Takenaka, Wako (JP); Takahiro Kashima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/055,271

(22) PCT Filed: Feb. 8, 2019

(86) PCT No.: PCT/JP2019/004680
§ 371 (c)(1),
(2) Date: Nov. 13, 2020

(87) PCT Pub. No.: WO2019/230059
PCT Pub. Date: Dec. 5, 2019

(65) Prior Publication Data

US 2021/0123408 A1 Apr. 29, 2021

(30) Foreign Application Priority Data

May 30, 2018 (JP) ..... JP2018-103976

(51) Int. Cl.
*F02P 9/00* (2006.01)
*F02P 3/045* (2006.01)
(Continued)

(52) U.S. Cl.
CPC ..... *F02P 9/002* (2013.01); *F02P 3/0453* (2013.01); *F02P 3/055* (2013.01); *F02P 5/1504* (2013.01)

(58) Field of Classification Search
CPC .... F02P 3/0407–0558; F02P 5/00; F02P 5/04; F02P 5/06; F02P 5/145–1504; F02P 9/00–002
(Continued)

(56) References Cited

U.S. PATENT DOCUMENTS 5,913,302 A * 6/1999 Ruman ..... F02P 9/002 123/609
9,404,467 B2 8/2016 Shiraishi et al.
(Continued)

FOREIGN PATENT DOCUMENTS

CN 105074199 A 11/2015
CN 105264219 A 1/2016
(Continued)

OTHER PUBLICATIONS

Office Action dated Nov. 2, 2021 in the corresponding Chinese Patent Application No. 201980036218.3 with the English translation thereof.

*Primary Examiner* — Robert A Werner
(74) *Attorney, Agent, or Firm* — Carrier Blackman & Associates, P.C.; Joseph P. Carrier; William D. Blackman

(57) ABSTRACT

An ignition coil control device includes: an energization control unit that controls to energize an ignition coil by first energization control and second energization control shorter in energization time than the first energization control; a cruise area determination unit that determines that a driving area of a vehicle is located in a cruise area on the basis of a throttle opening and an engine speed; and an integration counter that is incremented every predetermined time when the first energization control is being executed in the cruise area and is decremented every predetermined time in other cases. When a counter value of the integration counter reaches an upper limit value, a cooling process of switching from the first energization control to the second energization
(Continued)

control is executed. Such ignition coil control device can appropriately switch energization time while preventing excessive heating of an ignition coil without using a current sensor.

18 Claims, 10 Drawing Sheets

(51) Int. Cl.
*F02P 3/055* (2006.01)
*F02P 5/15* (2006.01)

(58) Field of Classification Search
USPC ..... 123/609, 406.11–406.13, 406.5–406.52, 123/406.58–406.65
See application file for complete search history.

(56) References Cited

U.S. PATENT DOCUMENTS

| | | | | |
|---|---|---|---|---|
| 9,835,127 | B2 | 12/2017 | Shiraishi et al. | |
| 10,138,862 | B2 * | 11/2018 | Cartwright | F02P 3/0456 |
| 2016/0084213 | A1 * | 3/2016 | Nakayama | F02P 3/08 123/634 |
| 2017/0058855 | A1 | 3/2017 | Nakamura | |

FOREIGN PATENT DOCUMENTS

| | | | |
|---|---|---|---|
| JP | S63-285264 | A | 11/1988 |
| JP | H05-069375 | U | 9/1993 |
| JP | H09-112395 | A | 4/1997 |
| JP | 2017-044108 | A | 3/2017 |

* cited by examiner

IGNITION COIL CONTROL DEVICE

TECHNICAL FIELD

The present invention relates to an ignition coil control device, and particularly to an ignition coil control device that performs energization control for an ignition coil sparking an ignition plug of an internal combustion engine.

BACKGROUND ART

An ignition coil control device that performs energization control for an ignition coil sparking an ignition plug of an internal combustion engine has been known from the past.

Patent Literature 1 discloses an ignition coil control device that estimates the temperature of an ignition coil on the basis of the terminal voltage of a battery and increases more discharge time of an ignition plug (increases the energization time of the ignition coil) when the temperature is low than that when the temperature is high, so that the ignitionability of the ignition plug is enhanced while preventing excessive heating of the ignition coil.

CITATION LIST

Patent Literature

Patent Literature 1: Japanese Unexamined Patent Application Publication No. 2017-44108

SUMMARY OF INVENTION

Technical Problem

When the energization time of an ignition coil is set longer in a predetermined driving area, improvement of drivability during driving can be expected along with improvement of ignitionability as disclosed in the technique of Patent Literature 1. However, the ignition coil control device of Patent Literature 1 has a problem that a current sensor for measuring the temperature of the ignition coil is necessary and the number of parts and the production cost are increased.

An object of the present invention is to solve the problem of the prior art, and is to provide an ignition coil control device that can appropriately switch energization time while preventing excessive heating of an ignition coil without using a current sensor.

Advantageous Effects of Invention

To achieve the afore-mentioned object, the present invention has a first feature in that an ignition coil control device that controls an ignition coil (29) sparking an ignition plug (28) of an engine (E) that is a power source of a vehicle (1), the device comprising:

an energization control unit (303) that controls to energize the ignition coil (29) by first energization control (L) and second energization control (S) shorter in energization time than the first energization control (L);

a cruise area determination unit (302) that determines that a driving area (A1, A2, A3, A4, A5, or A6) of the vehicle (1) is located in a cruise area (A1) on the basis of a throttle opening (Th) and an engine speed (Ne); and an integration counter (304) that is incremented every predetermined time (T1) when the first energization control (L) is being executed in the cruise area (A1) and is decremented every predetermined time (T2 or T3) in other cases, wherein when a counter value of the integration counter (304) reaches an upper limit value (Cu), the energization control unit (303) executes a cooling process of switching from the first energization control (L) to the second energization control (S).

To achieve the afore-mentioned object, the present invention has a second feature in that wherein when the counter value of the integration counter (304) reaches a lower limit value (Cd) during the execution of the cooling process, the energization control unit (303) terminates the cooling process.

To achieve the afore-mentioned object, the present invention has a third feature in that wherein a second predetermined time (T2) during which the integration counter (304) is decremented is longer than a first predetermined time (T1) during which the integration counter (304) is incremented.

To achieve the afore-mentioned object, the present invention has a fourth feature in that wherein when the driving area (A1, A2, A3, A4, A5, or A6) of the vehicle (1) is determined as an idle area (A4) on the basis of the throttle opening (Th) and the engine speed (Ne), the integration counter (304) decrements the integration counter (304) every predetermined time (T3) shorter than the second predetermined time (T2).

To achieve the afore-mentioned object, the present invention has a fifth feature in that wherein a default setting when the cruise area determination unit (302) determines as the cruise area (A1) is the first energization control (L), and wherein a second energization control switching unit (306) is provided to switch from the first energization control (L) to the second energization control (S) even in the cruise area (A1) when predetermined conditions are satisfied when the first energization control (L) is being executed in the cruise area (A1).

To achieve the afore-mentioned object, the present invention has a sixth feature in that wherein a cruise state determination unit (307) is provided to determine as a cruise state when the cruise area determination unit (302) determines as the cruise area (A1) and additional conditions (309) are satisfied, and wherein the predetermined condition is that the cruise state determination unit (307) determines as the cruise state when the first energization control (L) is being executed in the cruise area (A1).

To achieve the afore-mentioned object, the present invention has a seventh feature in that wherein the predetermined condition is that the throttle opening (Th) is largely reduced when the first energization control (L) is being executed in the cruise area (A1).

Effects of Invention

According to the first feature of the present invention, An ignition coil control device that controls an ignition coil (29) sparking an ignition plug (28) of an engine (E) that is a power source of a vehicle (1), the device comprising: an energization control unit (303) that controls to energize the ignition coil (29) by first energization control (L) and second energization control (S) shorter in energization time than the first energization control (L); a cruise area determination unit (302) that determines that a driving area (A1, A2, A3, A4, A5, or A6) of the vehicle (1) is located in a cruise area (A1) on the basis of a throttle opening (Th) and an engine speed (Ne); and an integration counter (304) that is incremented every predetermined time (T1) when the first energization control (L) is being executed in the cruise area (A1)

and is decremented every predetermined time (T2 or T3) in other cases, wherein when a counter value of the integration counter (304) reaches an upper limit value (Cu), the energization control unit (303) executes a cooling process of switching from the first energization control (L) to the second energization control (S). Therefore, estimating and detecting the temperature of the ignition coil using the integration counter, it is possible to prevent excessive heating of the ignition coil by switching from the first energization control to the second energization control without using a current sensor. Accordingly, by setting a driving area with high use frequency during the travel as the cruise area, the drivability in the cruise area can be enhanced by the first energization control by which improvement of accelerating performance can be expected.

According to the second feature of the present invention, wherein when the counter value of the integration counter (304) reaches a lower limit value (Cd) during the execution of the cooling process, the energization control unit (303) terminates the cooling process. Therefore, estimating and detecting that the ignition coil has been sufficiently cooled, it is possible to transit to a state where the second energization control can be returned to the first energization control.

According to the third feature of the present invention, wherein a second predetermined time (T2) during which the integration counter (304) is decremented is longer than a first predetermined time (T1) during which the integration counter (304) is incremented. Therefore, it is possible to cool the ignition coil while leaving a margin for an estimation value of the cooling speed of the ignition coil.

According to the fourth feature of the present invention, wherein when the driving area (A1, A2, A3, A4, A5, or A6) of the vehicle (1) is determined as an idle area (A4) on the basis of the throttle opening (Th) and the engine speed (Ne), the integration counter (304) decrements the integration counter (304) every predetermined time (T3) shorter than the second predetermined time (T2). Therefore, the decrement of the integration counter can be executed in accordance with the idle area where the temperature of the ignition coil is likely to be lowered.

According to the fifth feature of the present invention, wherein a default setting when the cruise area determination unit (302) determines as the cruise area (A1) is the first energization control (L), and wherein a second energization control switching unit (306) is provided to switch from the first energization control (L) to the second energization control (S) even in the cruise area (A1) when predetermined conditions are satisfied when the first energization control (L) is being executed in the cruise area (A1). Therefore, under the predetermined condition in which it is not necessary to enhance the drivability although the driving area of the vehicle is located in the cruise area, the cooling of the ignition coil can be facilitated by switching to the second energization control.

According to the sixth feature of the present invention, wherein a cruise state determination unit (307) is provided to determine as a cruise state when the cruise area determination unit (302) determines as the cruise area (A1) and additional conditions (309) are satisfied, and wherein the predetermined condition is that the cruise state determination unit (307) determines as the cruise state when the first energization control (L) is being executed in the cruise area (A1). Therefore, for example, by setting the additional condition in which the predetermined time elapses in a state where the change amount of the throttle opening is small, it can be determined that the driving state is the cruise state where the vehicle cruises at a constant speed. Accordingly, it is not necessary to enhance the drivability in the cruise state where the vehicle cruises at a constant speed even in the cruise area. In addition, the cooling of the ignition coil can be facilitated by switching to the second energization control.

According to the seventh feature of the present invention, wherein the predetermined condition is that the throttle opening (Th) is largely reduced when the first energization control (L) is being executed in the cruise area (A1). Therefore, it is not necessary to enhance the drivability in a deceleration state where the throttle is largely closed even in the cruise area. In addition, the cooling of the ignition coil can be facilitated by switching to the second energization control.

DESCRIPTION OF EMBODIMENTS

DESCRIPTION OF EMBODIMENTS

Figure 1:
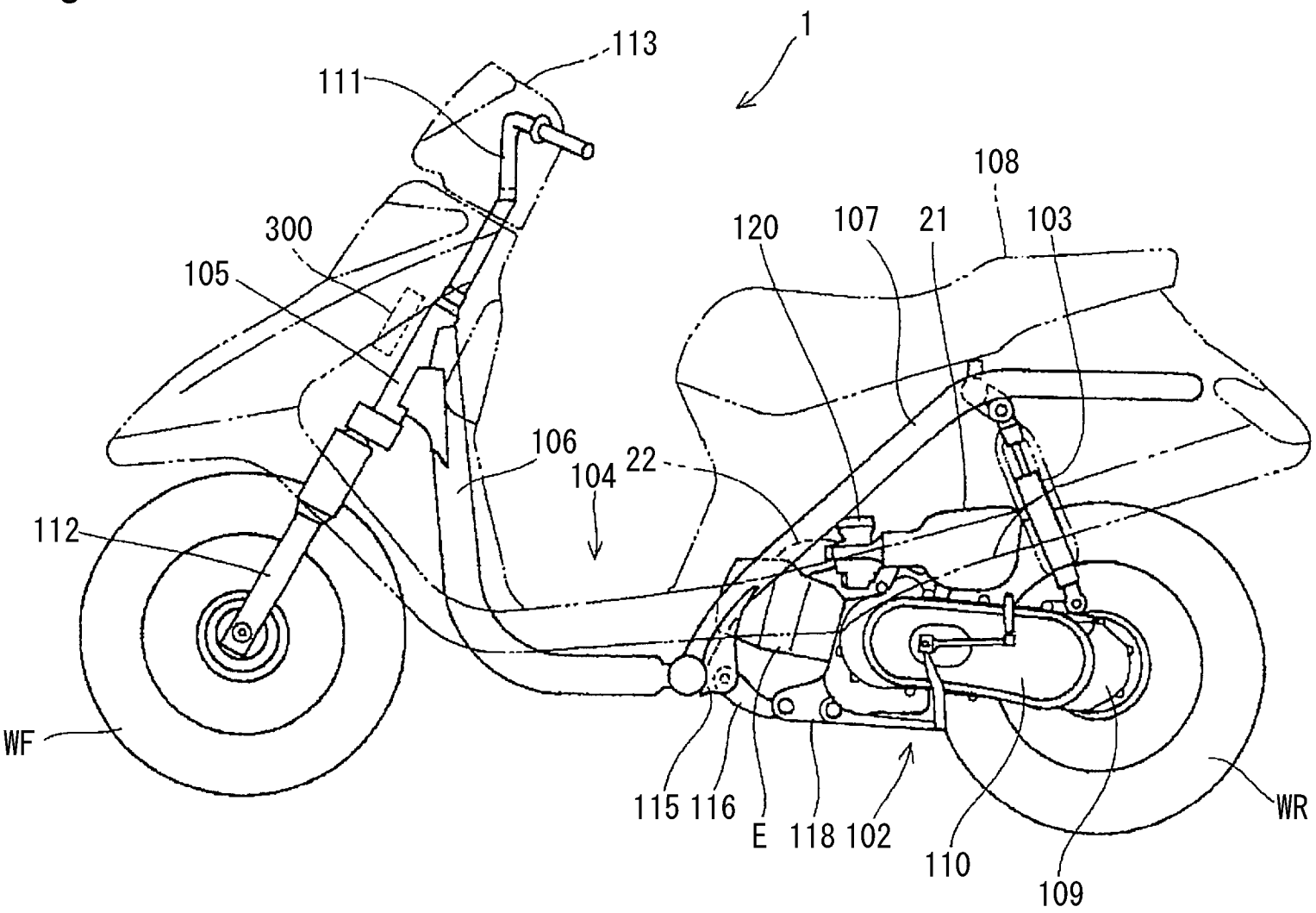
FIG. 1 is a left side view of a scooter type motorcycle to which an ignition coil control device according to an embodiment of the present invention is applied.

Hereinafter, a preferred embodiment of the present invention will be described in detail with reference to the drawings. FIG. 1 is a left side view of a scooter type motorcycle 1 to which an ignition coil control device according to an embodiment of the present invention is applied. The vehicle-body front part and the vehicle-body rear part of the motorcycle 1 are coupled to each other through a low floor-type floor unit 104. A vehicle-body frame is generally configured using a down tube 106 and a main pipe 107, and a seat 108 is arranged above the main pipe 107.

A handlebar 111 extends upward while being pivotally supported by a head pipe 105, and a front fork 112 that rotatably and pivotally supports a front wheel WF is attached to one lower end thereof. A handlebar cover 113 serving as an instrument panel is attached to an upper part of the handlebar 111. In addition, an ECU 300 is arranged in front of the head pipe 105.

A bracket 115 is provided while protruding at a rear end of the down tube 106 and at a rising part of the main pipe 107. A hanger bracket 118 of a swing unit 102 is swingably supported by the bracket 115 through a ring member 116.

A four-cycle single cylinder engine E is arranged at a front part of the swing unit 102. A continuously variable transmission 110 is arranged behind the engine E, and a rear wheel WR is pivotally supported by an output shaft of a deceleration mechanism 109. A rear cushion 103 is interposed between an upper end of the deceleration mechanism 109 and a bent part of the main pipe 107. A throttle body 120 and an air cleaner 21 of a fuel injection device connected to an intake passage 22 extending from the engine E are arranged above the swing unit 102.

Figure 2:
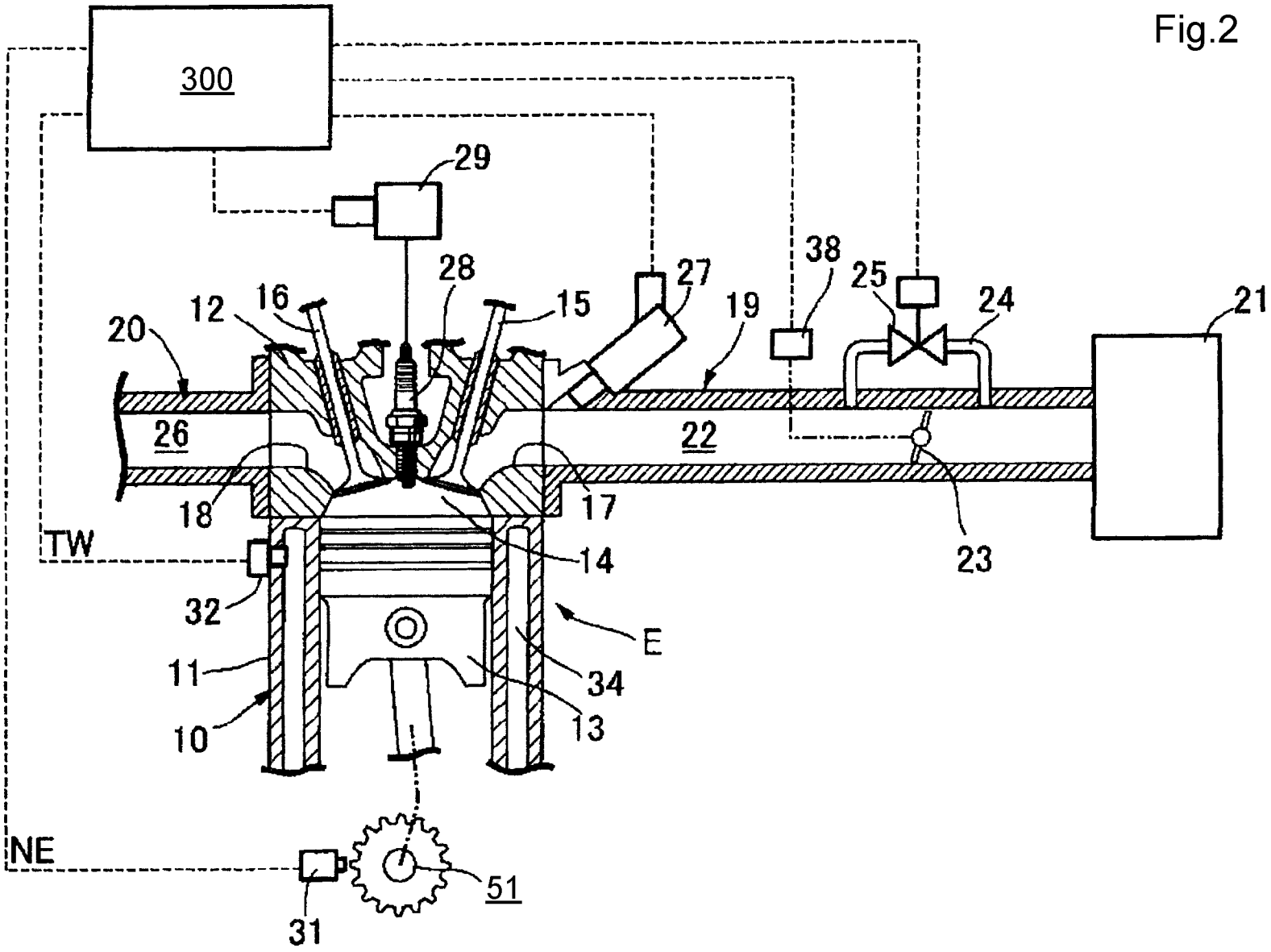
FIG. 2 is a diagram for showing a configuration of the engine while mainly focusing on a configuration of an intake device.

FIG. 2 is a diagram for showing a configuration of the engine E while mainly focusing on a configuration of an intake device. Between a cylinder block 11 and a cylinder head 12 of the engine body 10, formed is a combustion chamber 14 where a top portion of a piston 13 slidably fitted to the cylinder block 11 faces. In a cylinder head 12, provided is an intake port 17 for which communication or disconnection to the combustion chamber 14 is switched by an intake valve 15 that is openably and closably provided to the cylinder head 12.

An intake device 19 having the air cleaner 21 at an upstream end and an intake passage 22 connecting between the air cleaner 21 and the intake port 17 is connected to the cylinder head 12. An openable and closable throttle valve 23 is interposed in the middle of the intake passage 22, an auxiliary intake passage 24 bypassing the throttle valve 23 is connected to the intake passage 22, and an auxiliary air valve 25 is interposed in the auxiliary intake passage 24. The auxiliary air valve 25 is a solenoid valve that is a normally-closed (usually-closed) valve, namely, that is closed in a non-energized state and is opened by being energized. In addition, an exhaust port 18 for which communication or disconnection to the combustion chamber 14 is switched by an exhaust valve 16 that is openably and closably provided to the cylinder head 12 is provided in the cylinder head 12, and an exhaust device 20 having an exhaust passage 26 communicating with the exhaust port 18 is connected to the cylinder head 12.

A fuel injection valve 27 that injects a fuel towards the intake port 17 is attached to a downstream end of the intake device 19, an ignition plug 28 whose tip end faces the combustion chamber 14 is mounted to the cylinder head 12, and an ignition coil 29 for applying a high voltage at an ignition timing is connected to the ignition plug 28.

Each of the fuel injection timing and the fuel injection amount of the fuel injection valve 27 and the energization timing and the energization time of the ignition coil 29 is controlled by the ECU 300. A detection value of an engine speed sensor 31 that detects the revolution speed of a crank shaft 51 linked to the piston 13, namely, an engine speed Ne, a detection value of a temperature detection unit 32 that detects an index representing the temperature of the engine, for example, the temperature of a cooling jacket 34, and a detection value of a throttle opening sensor 38 that detects the rotation amount of the throttle valve 23 to detect a throttle operation or an accelerator pedal depression state are input to the ECU 300, and the fuel injection valve 27 and the ignition coil 29 are driven on the basis of these parameters.

Figure 3:
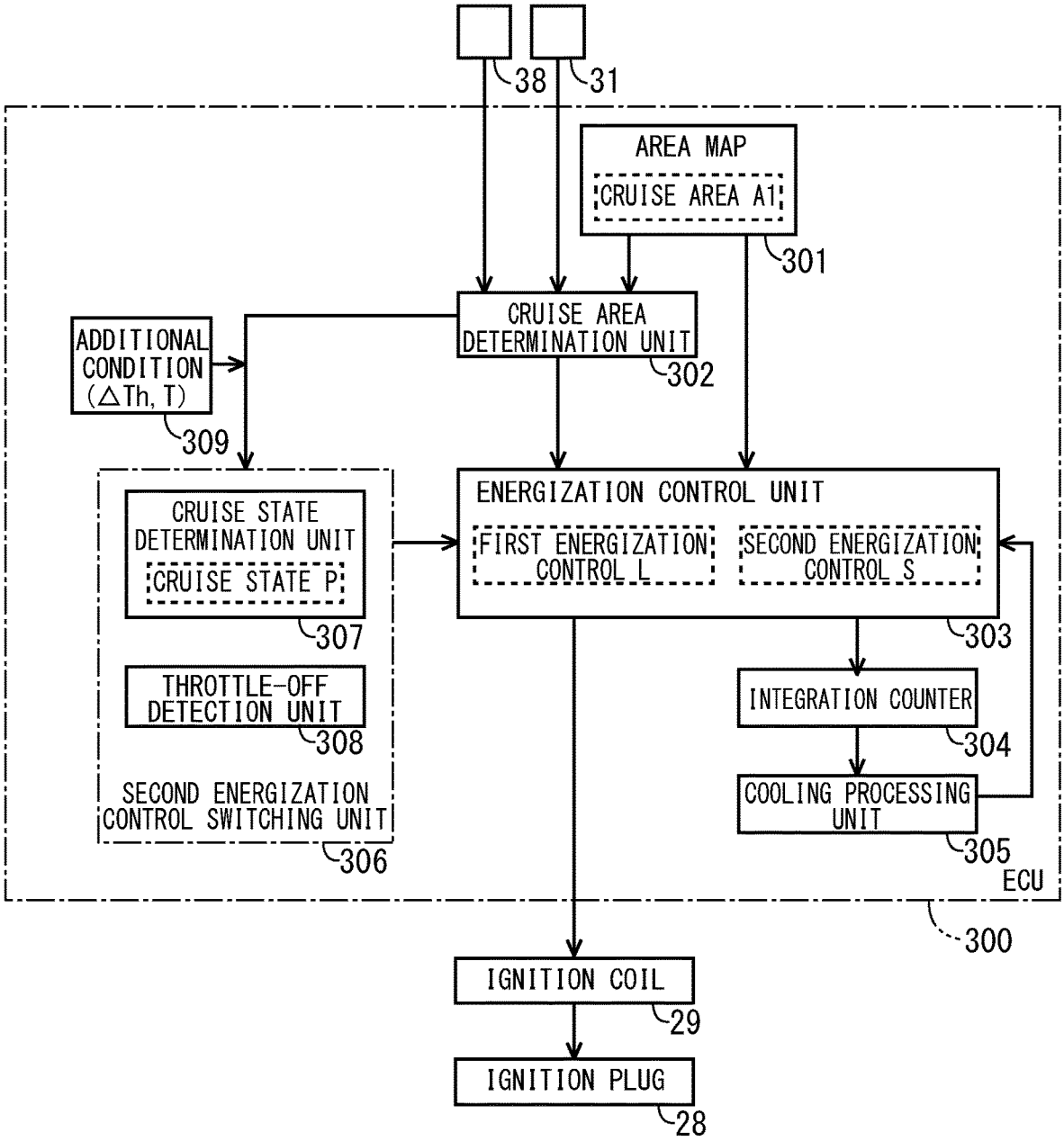
FIG. 3 is a block diagram for showing a configuration of the ECU as an ignition coil control device.

FIG. 3 is a block diagram for showing a configuration of the ECU 300 as an ignition coil control device. The drawing shows a configuration focusing on an energization control unit 303 that performs energization control for the ignition coil 29. The energization control unit 303 provided in the ECU 300 executes the energization control for the ignition coil 29 by first energization control L having a long energization time and second energization control S that is shorter in energization time than the first energization control L. The switching between the first energization control L and the second energization control S is mainly executed on the basis of a driving area lead by an area map 301.

Figure 4:
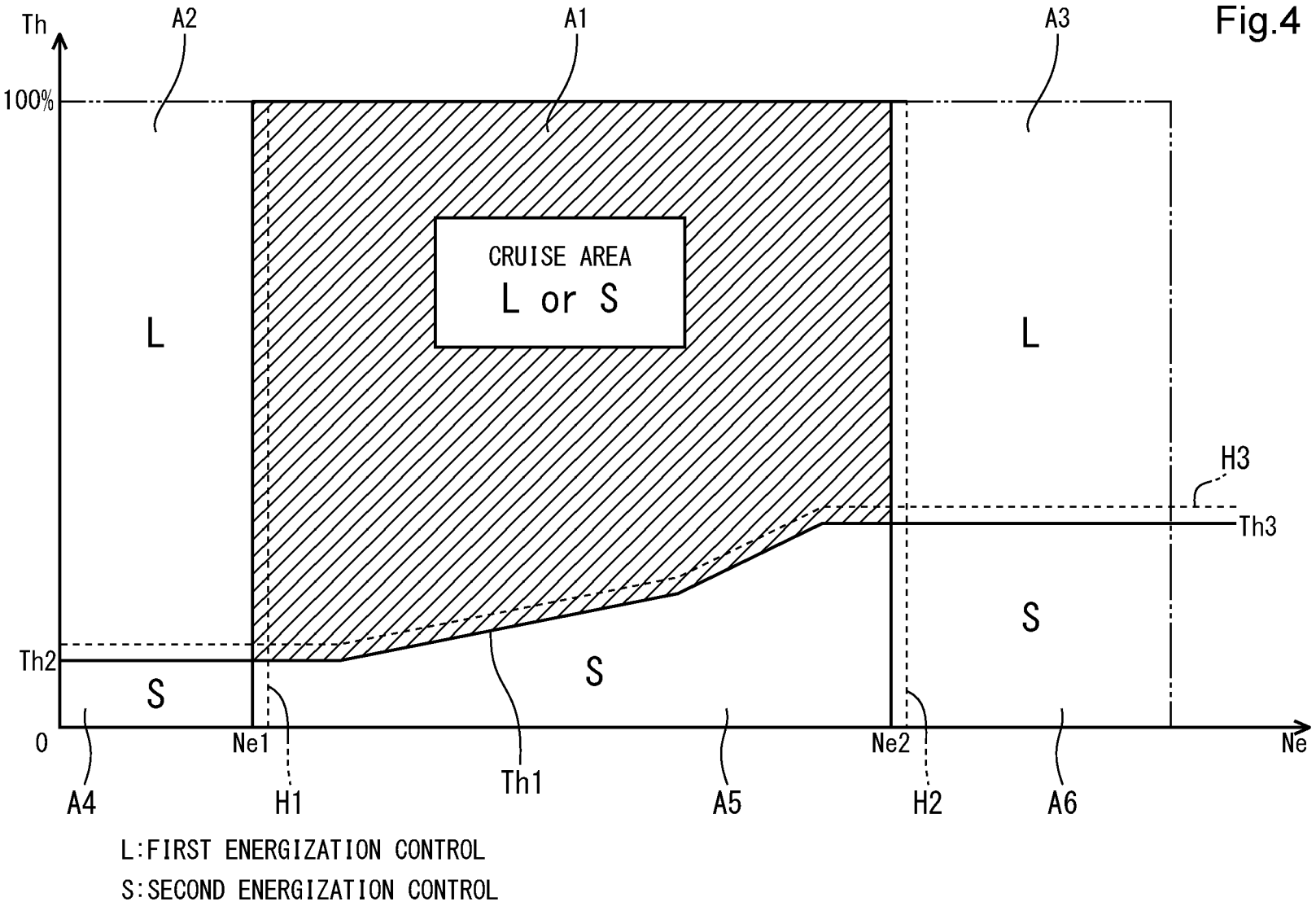
FIG. 4 is an explanatory diagram for showing an outline of the area map 301.

The area map 301 defines six driving areas on the basis of a throttle opening Th detected by the throttle opening sensor 38 and the engine speed Ne detected by the engine speed sensor 31 (see FIG. 4). A cruise area determination unit 302 determines whether or not the current driving area is located in a cruise area A1 defined by the area map 301 on the basis of the throttle opening Th and the engine speed Ne.

While the energization control unit 303 mutually switches the first energization control L and the second energization control S in the cruise area A1, the energization control unit 303 executes, in a driving area other than the cruise area A1, energization control that is preliminarily set for each driving area of the area map 301. It should be noted that the energization control by the first energization control L is performed during a period after starting the engine E to completion of a warming-up operation detected using a cooling water temperature or the like irrespective of the driving area.

An integration counter 304 is incremented every predetermined time only when the first energization control L is being executed in the cruise area A1, and is otherwise decremented every predetermined time. This setting is adapted for the temperature rise of the ignition coil 29 during the execution of the first energization control L in the cruise area A1.

In addition, the ECU 300 as an ignition coil control device according to the embodiment includes a cooling processing unit 305 to prevent excessive heating of the ignition coil by forcibly switching the first energization control L to the second energization control S. When the counter value C of the integration counter 304 reaches a predetermined upper limit value, the cooling processing unit 305 executes a cooling process for switching the first energization control L to the second energization control S. When the counter value C reaches a predetermined lower limit value, the cooling processing unit 305 terminates the cooling process to transit to a state in which the first energization control L can be executed.

Accordingly, the temperature of the ignition coil 29 is estimated and detected by the integration counter 304, and it is possible to prevent excessive heating of the ignition coil 29 by switching from the first energization control L to the second energization control S without using a current sensor. In addition, by setting a driving area with high use frequency during the travel as the cruise area A1, while the drivability in the cruise area A1 can be enhanced by the first energization control L by which improvement of accelerating performance can be expected, production costs of vehicles can be reduced by applying the ignition coil whose guaranteed temperature is lower.

In addition, information from a second energization control switching unit 306 is input into the energization control unit 303. In the embodiment, the first energization control L is the default setting when being determined as the cruise area A1. The second energization control switching unit 306 has a function of switching from the first energization control L to the second energization control even in the cruise area A1 by satisfying predetermined conditions after being determined as the cruise area A1. In the embodiment, as the predetermined conditions, the driving state is determined as a cruise state by a cruise state determination unit 307, and the throttle opening is largely reduced by a throttle-off detection unit 308. When the cruise area determination unit 302 determines that the driving area of the vehicle is located in the cruise area A1 and additional conditions 309 are satisfied, the cruise state determination unit 307 determines that the driving state of the vehicle is a cruise state P.

FIG. 4 is an explanatory diagram for showing an outline of the area map 301. As described above, in the area map 301, the driving area of the vehicle is defined while being divided into 6 on the basis of the throttle opening Th and the engine speed Ne. An area where the engine speed Ne is a medium speed (Ne1≤Ne<Ne2) and the throttle opening Th is from a medium opening to a high opening (Th≥Th1) is defined as the cruise area (first area) A1 with the highest use frequency during the travel. In addition, an area where the engine speed Ne is a low speed (Ne<Ne1) and the throttle opening Th is from a medium opening to a high opening (Th≥Th2) is defined as a second area A2, and an area where the engine speed Ne is a high speed (Ne≥Ne2) and the throttle opening Th is from a medium opening to a high opening (Th≥Th3) is defined as a third area A3.

Further, an area where the engine speed Ne is a low speed (Ne<Ne1) and the throttle opening Th is a low opening (Th<Th2) is defined as an idle area (fourth area) A4, an area where the engine speed Ne is a medium speed (Ne1≤Ne<Ne2) and the throttle opening Th is a low opening (Th<Th1) is defined as a fifth area A5, and an area where the engine speed Ne is a high speed (Ne≥Ne2) and the throttle opening Th is from a medium opening to a low opening (Th<Th3) is defined as a sixth area.

In the area map 301 according to the embodiment, except that the first energization control L or the second energization control S is selectively executed in the cruise area A1, the energization control is executed by "L" in the second area A2, by "L" in the third area A3, by "S" in the idle area A4, by "S" in the fifth area A5, and by "L" in the sixth area A6.

In the second area A2 and the fifth area A5, the first energization control L is executed, but the integration counter 304 is decremented. This is because the engine speed Ne is small in the second area A2 and the duration of the fifth area A5 is usually short, and thus the possibility of excessive heating of the ignition coil 29 is low.

It should be noted that hysteresises H1 and H2 for delaying the timing of boundary transition due to a rise in the engine speed Ne are provided for the engine speeds Ne1 and Ne2 serving as boundaries of the driving areas. In addition, a hysteresis H3 for delaying the timing of boundary transition due to a rise in the throttle opening Th is provided for the throttle openings Th1, Th2, and Th3 serving as boundaries between the driving areas. Each of the hysteresises H1, H2, and H3 may be added and provided on the opposite side across the boundary.

Figure 5:
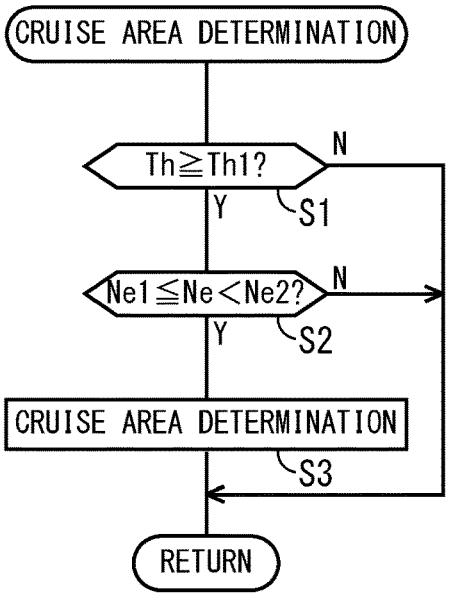
FIG. 5 is a flowchart for showing a procedure of a cruise area determination.

FIG. 5 is a flowchart for showing a procedure of a cruise area determination. In Step S1, it is determined whether or not the throttle opening Th is equal to or larger than a predetermined opening Th1. When a positive determination is made in Step S1, the flow proceeds to Step S2 to determine whether or not the engine speed Ne is equal to or larger than a first predetermined speed Ne1 and smaller than a second predetermined speed Ne2. When a positive determination is made in Step S2, the flow proceeds to Step S3, and the cruise area determination unit 302 determines that the driving area is in the cruise area A1. On the other hand, when a negative determination is made in Step S1 or S2, a series of control is terminated at the time.

Figure 6:
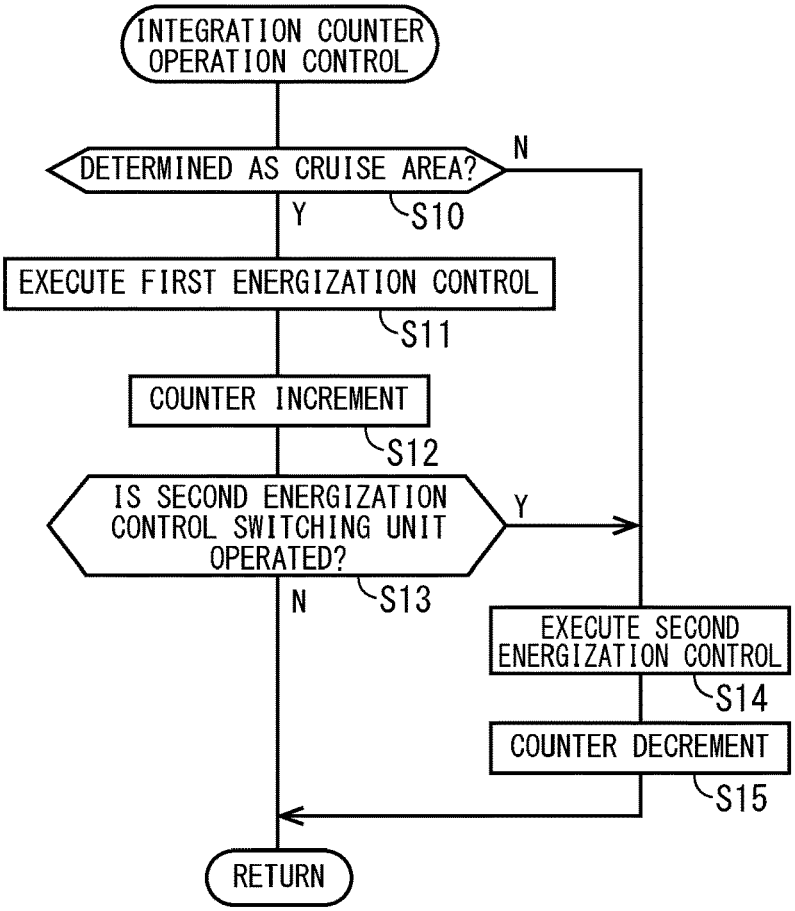
FIG. 6 is a flowchart for showing a procedure of integration counter operation control.

FIG. 6 is a flowchart for showing a procedure of integration counter operation control. In Step S10, it is determined whether or not a cruise area determination has been made. When a positive determination is made in Step S10, the flow proceeds to Step S11 to execute the first energization control L that is the default setting when the cruise area A1 is determined. Then, the integration counter 304 is incremented in Step S12.

On the other hand, when a negative determination is made in Step S10, namely, when it is determined that the driving area is other than the cruise area A1, the flow proceeds to Step S14 to execute the second energization control S. In Step S15 that follows, the integration counter 304 is decremented.

In addition, after the counter increment is executed in Step S12, it is determined whether or not the second energization control switching unit 306 has been operated in Step S13. When a positive determination is made in Step S13, the flow proceeds to Step S14 to execute the second energization control S. On the other hand, when a negative determination is made, a series of control is terminated at the time. As described above, a positive determination is made in the determination in Step S13 if the cruise state determination unit 307 determines that the driving state is the cruise state P or if the throttle-off detection unit 308 detects a large decrease in the throttle opening.

Figure 7:
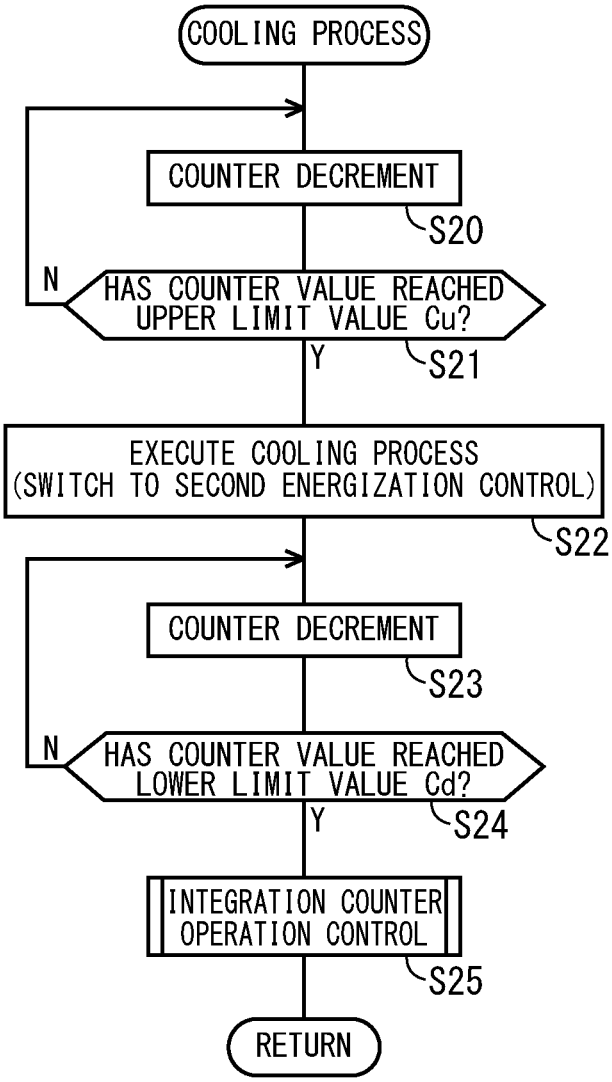
FIG. 7 is a flowchart for showing a procedure of a cooling process.

FIG. 7 is a flowchart for showing a procedure of a cooling process. In Step S20, the integration counter 304 is incremented in accordance with the execution of the first energization control L in the cruise area A1. In Step S21, it is determined whether or not the counter value C of the integration counter 304 has reached an upper limit value Cu. When a positive determination is made in Step S21, the flow proceeds to Step S22 to execute the cooling process for forcibly switching from the first energization control L to the second energization control S. On the other hand, when a negative determination is made in Step S21, the flow returns to Step S20.

In Step S23, the integration counter 304 is decremented in accordance with the execution of the second energization control S. In Step S24 that follows, it is determined whether or not the counter value C has reached a lower limit value Cd. When a positive determination is made, the flow proceeds to Step S25 to execute the integration counter operation control shown in FIG. 6. Namely, after the cooling process of forcibly executing the second energization control S is completed, the cruise area determination is executed again by transiting to an energization time switching permission state.

It should be noted that the operation of the integration counter 304 is started in accordance with the completion of a warming-up operation detected using a cooling water temperature or the like after the engine E is started, and is continued until the engine E stops. In addition, the counter value C is 0 when the operation of the integration counter 304 is started, and is reset when the engine E stops. In addition, the counter value C can be reset with the elapse of a predetermined time after the engine E stops.

Figure 8:
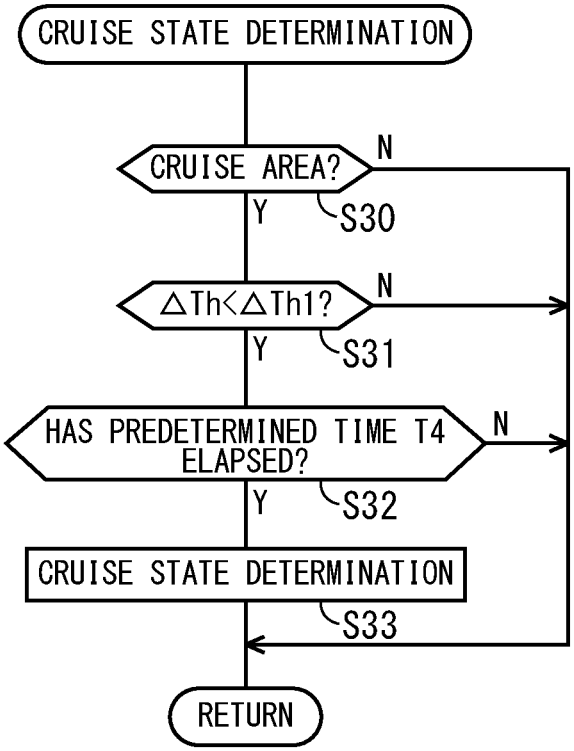
FIG. 8 is a flowchart for showing a procedure of a cruise state determination.

FIG. 8 is a flowchart for showing a procedure of a cruise state determination. In Step S30, it is determined whether or not the driving area is located in the cruise area A1. When a positive determination is made, the flow proceeds to Step S31. In Step S31, as the first condition of the two additional conditions 309 (see FIG. 3), it is determined whether or not the change amount ΔTh of the throttle opening is smaller than a predetermined value ΔTh1. When a positive determination is made in Step S31, it is determined whether or not a predetermined time T4 has elapsed in Step S32 as the second condition of the additional conditions 309. When a positive determination is made in Step S32, the flow proceeds to Step S33, and the cruise state determination unit 307 determines that the driving state is the cruise state P. Then, a series of control is terminated. It should be noted that when a negative determination is made in Step S31 or S32, a series of control is terminated at the time.

According to the above-described cruise state determination, when the driving area is located in the cruise area A1 and the additional condition 309 in which the predetermined time T4 elapses in a state where the change amount ΔTh of the throttle opening is small is satisfied, it can be determined that the driving state is the cruise state P where the vehicle cruises at a constant speed. As described above, when it is determined that the driving state is the cruise state P, the control is switched to the second energization control S by the second energization control switching unit 306. Accordingly, it is not necessary to enhance the drivability in the cruise state P where the vehicle cruises at a constant speed even in the cruise area A1. In addition, the cooling of the ignition coil 29 can be facilitated by switching to the second energization control.

In addition, the second energization control switching unit 306 is operated even in the case where the throttle opening Th is largely reduced. Accordingly, it is not necessary to enhance the drivability in a deceleration state where the throttle is largely closed even in the cruise area A1. In addition, the cooling of the ignition coil 29 can be facilitated by switching to the second energization control S.

Figure 9:
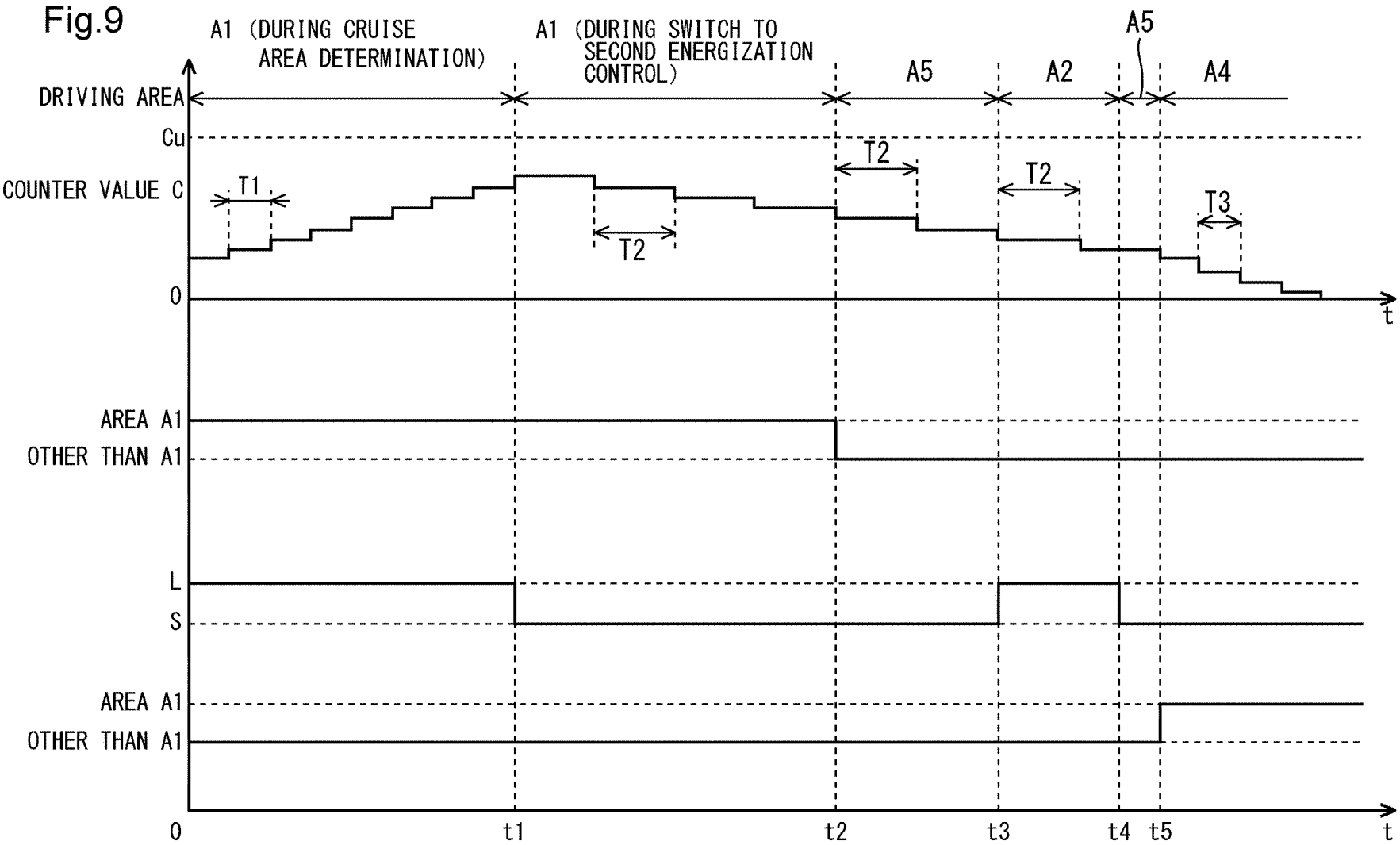
FIG. 9 is a time chart for showing an operation state of the integration counter 304.

FIG. 9 is a time chart for showing an operation state of the integration counter 304. This time chart shows the driving area, the counter value C, a determination whether or not the driving area is in the cruise area A1, selection of the first energization control L or the second energization control S, and a determination whether or not the driving area is in the idle area A4 in order from the upper stage. In addition, this time chart shows a state where the counter value C is transited across plural driving areas in a range where the counter value C does not reach the upper limit value Cu.

At time t=0, the first energization control L is executed in the cruise area A1, and the integration counter 304 is continuously being incremented. The increment of the integration counter 304 is executed by increasing the counter value C every predetermined time T1 by 1.

Next, the second energization control switching unit 306 is operated in the cruise area A1 at time t1, and switching from the first energization control L to the second energization control S is executed. Thereby, the decrement of the integration counter 304 is started. The decrement is executed by decreasing the counter value C by 1 every predetermined time T2 that is longer than (for example, twice) the predetermined time T1. Accordingly, it is possible to cool the ignition coil 29 while leaving a margin for an estimation value of the cooling speed of the ignition coil 29.

Next, the driving area is transited from the cruise area A1 to the fifth area A5 in accordance with changes in the throttle opening Th and the engine speed Ne at time t2. In the fifth area A5, the second energization control S is executed, and the predetermined time T2 at the time of the decrement is the same as the case in which the second energization control switching unit 306 is operated in the cruise area A1. It should be noted that the transition of the counter value C in the fifth area A5 is the same as that in the sixth area A6.

Next, the fifth area A5 is transited to the second area A2 at time t3. Although the first energization control L is executed in the second area A2, the counter value C is decremented. The predetermined time T2 at the time of the decrement is the same as the case in which the second energization control switching unit 306 is operated in the cruise area A1. In addition, the transition of the counter value C in the second area A2 is the same as that in the third area A3.

Further, the second area A2 is transited to the fifth area A5 again at time t4, and the fifth area A5 is transited to the idle area A4 at time t5. The decrement of the counter value C in the idle area A4 is set so that the counter value C is decreased by 1 every predetermined time T3 shorter than the predetermined time T2. Accordingly, the temperature of the ignition coil 29 is likely to be lowered in the idle area A4. Thus, the decrement of the integration counter 304 can be executed.

Figure 10:
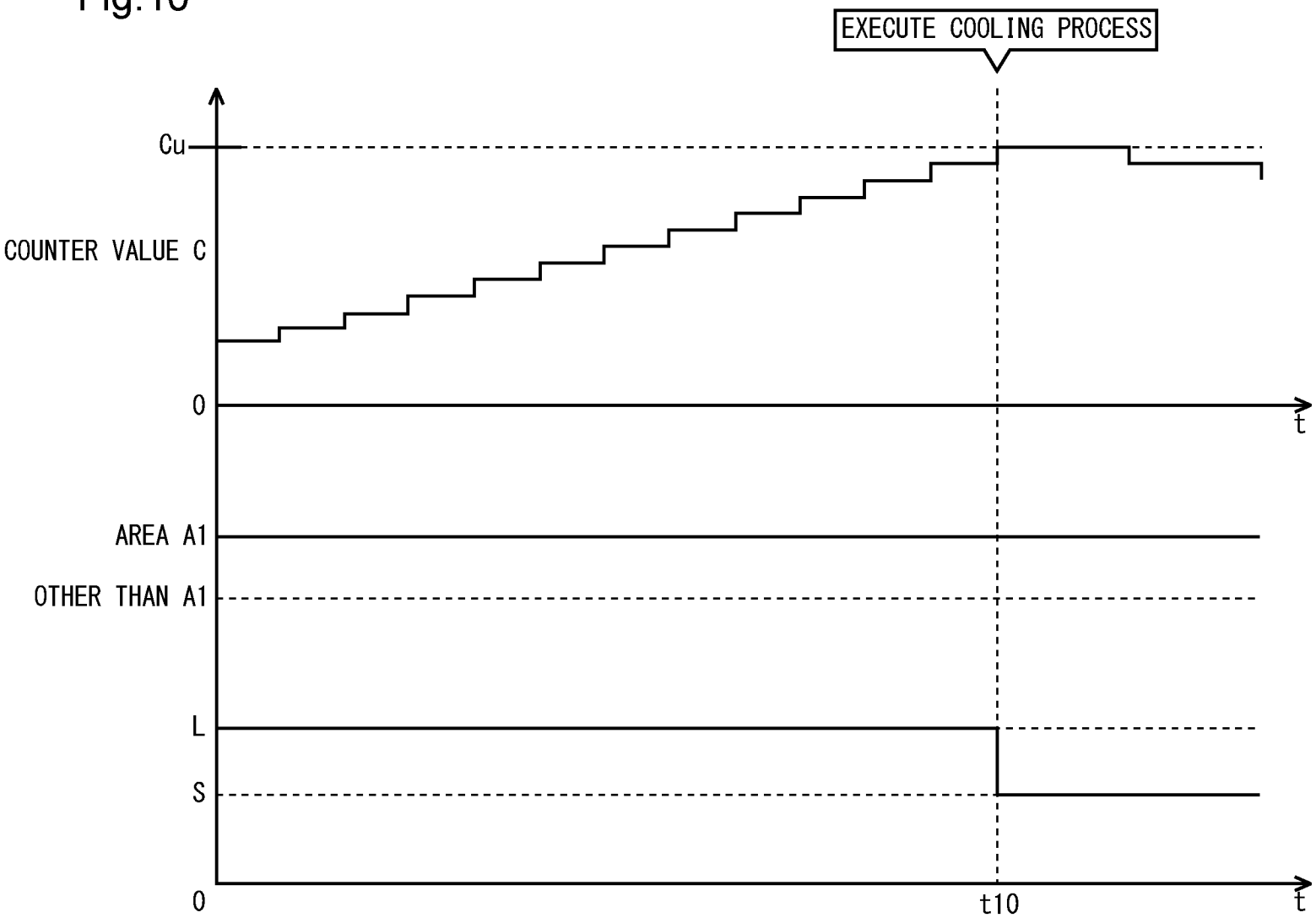
FIG. 10 is a time chart for showing a state in which the cooling process is executed when the counter value C reaches the upper limit value Cu.

FIG. 10 is a time chart for showing a state in which the cooling process is executed when the counter value C reaches the upper limit value Cu. At time t=0, the first energization control L is executed in the cruise area A1, and the increment of the integration counter 304 is being continued. Next, when the counter value C reaches the upper limit value Cu at time T10, the cooling process of forcibly switching from the first energization control L to the second energization control S is executed. Along with the execution of the cooling process, the decrement of the integration counter 304 is started.

Figure 11:
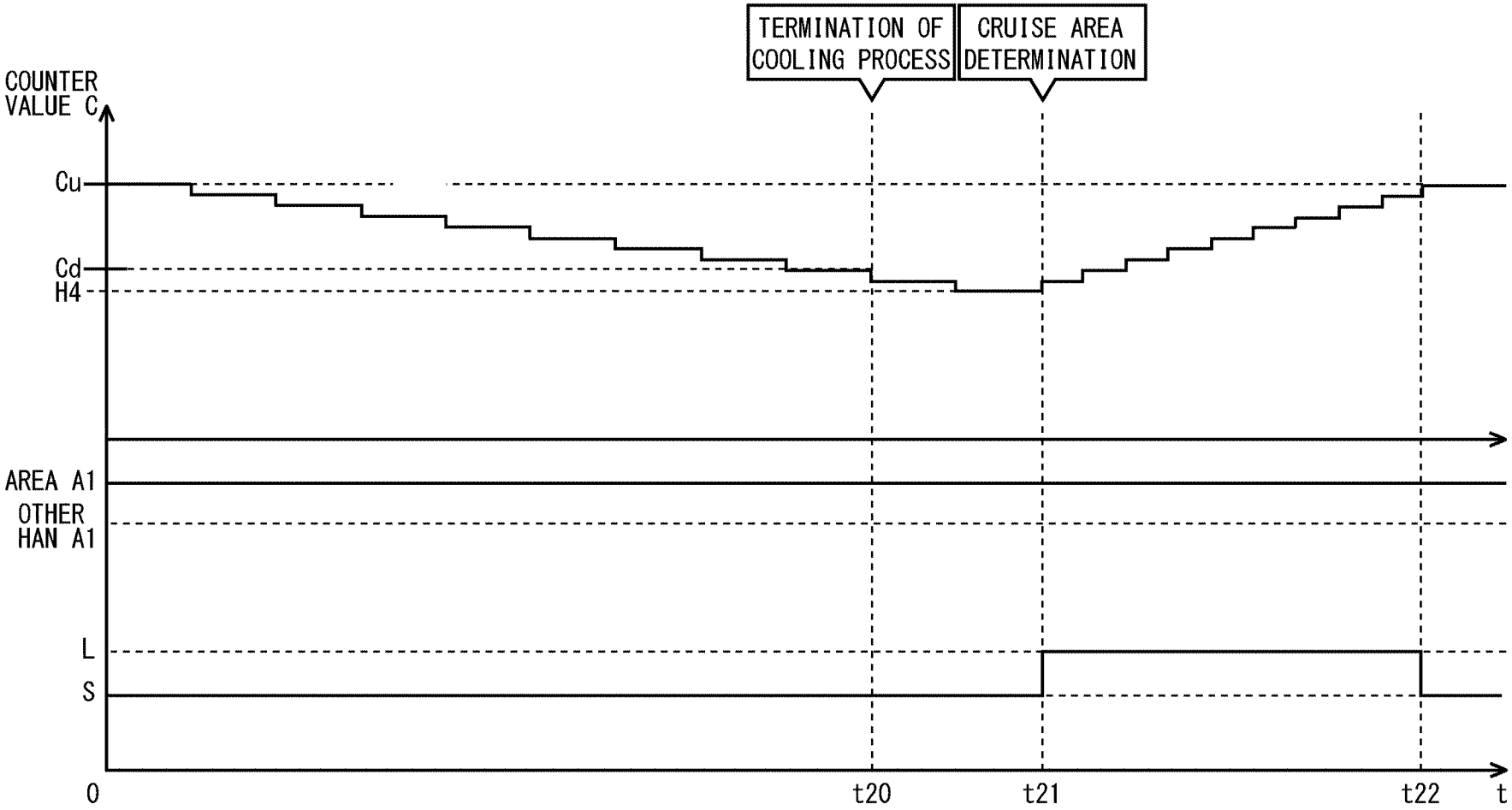
FIG. 11 is a time chart for showing a state in which the cooling process is terminated when the counter value C reaches the lower limit value Cd.

FIG. 11 is a time chart for showing a state in which the cooling process is terminated when the counter value C reaches the lower limit value Cd. At time t=0, the second energization control S is executed by the cooling process, and the decrement of the integration counter 304 is being continued.

When the counter value C reaches the lower limit value Cd at time t20, the cooling process is terminated, and the state is transited to the energization time switching permission state. Namely, if it is determined as the cruise area A1 after the termination of the cooling process, it is possible to return to the first energization control L. In this point, the driving area is transited to the fifth area A5 or the sixth area A6 during the execution of the cooling process, and the determination of the cruise area A1 is not established at time t20 when the cooling process is terminated in the time chart. Therefore, the decrement of the integration counter 304 remains continued even after time t20. Then, when it is determined as the cruise area A1 at time t21, the increment of the integration counter 304 is started. Then, when the counter value C reaches the upper limit value Cu again at time t22, the cooling process is started.

It should be noted that if a counter hysteresis value H4 slightly smaller than the lower limit value Cd is set, the increment can be started after the counter value C reaches the counter hysteresis value H4 without starting the increment along with the termination of the cooling process even in the case where it is determined as the cruise area A1 at the time of the termination of the cooling process. In addition, a hysteresis having the upper limit value Cu as a boundary may be set.

It should be noted that the configuration of the motorcycle, the configuration of the ignition coil, the energization time of the first energization control and the second energization control, the configuration of the area map, the determination conditions of the cruise area and the cruise state, the upper limit value and the lower limit value of the counter value of the integration counter, the predetermined time at the time of the increment and decrement of the integration counter, and the settings of various hysteresis values are not limited to the above-described embodiment, and can be variously changed. The ignition coil control device according to the present invention can be applied to various vehicles having engines as power sources in addition to sports-type motorcycles.

REFERENCE SIGNS LIST

1 . . . motorcycle (vehicle), 28 . . . ignition plug, 29 . . . ignition coil, 302 . . . cruise area determination unit, 303 . . . energization control unit, 304 . . . integration counter, 306 . . . second energization control switching unit, 307 . . . cruise state determination unit, 309 . . . additional conditions, E . . . engine, A1 . . . cruise area, A3 . . . third area, A4 . . . idle area (fourth area), A5 . . . fifth area, A6 . . . sixth area, C . . . counter value, Cu . . . upper limit value, L . . . first energization control, S . . . second energization control, P . . . cruise state, T1 . . . first predetermined time, T2 . . . second predetermined time, T3 . . . third predetermined time, T4 . . . fourth predetermined time, Th . . . throttle opening, Ne . . . engine speed

The invention claimed is:

1. An ignition coil control device that controls an ignition coil sparking an ignition plug of an engine that is a power source of a vehicle, the device comprising:

an energization control unit that controls to energize the ignition coil by first energization control and second energization control shorter in energization time than the first energization control;

a cruise area determination unit that determines that a driving area of the vehicle is located in a cruise area on the basis of a throttle opening and an engine speed; and an integration counter that is incremented every predetermined time when the first energization control is being executed in the cruise area and is decremented every predetermined time in other cases, wherein when a counter value of the integration counter reaches an upper limit value, the energization control unit executes a cooling process of switching from the first energization control to the second energization control, and wherein a second predetermined time during which the integration counter is decremented is longer than a first predetermined time during which the integration counter is incremented.

2. The ignition coil control device according to claim 1, wherein when the counter value of the integration counter reaches a lower limit value during the execution of the cooling process, the energization control unit terminates the cooling process.

3. The ignition coil control device according to claim 1, wherein when the driving area of the vehicle is determined as an idle area on the basis of the throttle opening and the engine speed, the integration counter decrements the integration counter every predetermined time shorter than the second predetermined time.

4. The ignition coil control device according to claim 1, wherein a default setting when the cruise area determination unit determines as the cruise area is the first energization control, and wherein a second energization control switching unit is provided to switch from the first energization control to the second energization control even in the cruise area when predetermined conditions are satisfied when the first energization control is being executed in the cruise area.

5. The ignition coil control device according to claim 4, wherein a cruise state determination unit is provided to determine as a cruise state when the cruise area determination unit determines as the cruise area and additional conditions are satisfied, and wherein the predetermined condition is that the cruise state determination unit determines as the cruise state when the first energization control is being executed in the cruise area.

6. The ignition coil control device according to claim 4, wherein the predetermined condition is that the throttle opening is largely reduced when the first energization control is being executed in the cruise area.

7. The ignition coil control device according to claim 2, wherein when the driving area of the vehicle is determined as an idle area on the basis of the throttle opening and the engine speed, the integration counter decrements the integration counter every predetermined time shorter than the second predetermined time.

8. The ignition coil control device according to claim 2, wherein a default setting when the cruise area determination unit determines as the cruise area is the first energization control, and wherein a second energization control switching unit is provided to switch from the first energization control to the second energization control even in the cruise area when predetermined conditions are satisfied when the first energization control is being executed in the cruise area.

9. The ignition coil control device according to claim 3, wherein a default setting when the cruise area determination unit determines as the cruise area is the first energization control, and wherein a second energization control switching unit is provided to switch from the first energization control to the second energization control even in the cruise area when predetermined conditions are satisfied when the first energization control is being executed in the cruise area.

10. An ignition coil control device that controls an ignition coil sparking an ignition plug of an engine that is a power source of a vehicle, the device comprising:

an energization control unit that controls to energize the ignition coil by first energization control and second energization control shorter in energization time than the first energization control;

a cruise area determination unit that determines that a driving area of the vehicle is located in a cruise area on the basis of a throttle opening and an engine speed; and an integration counter that is incremented every predetermined time when the first energization control is being executed in the cruise area and is decremented every predetermined time in other cases, wherein when a counter value of the integration counter reaches an upper limit value, the energization control unit executes a cooling process of switching from the first energization control to the second energization control, wherein a default setting when the cruise area determination unit determines as the cruise area is the first energization control, and wherein a second energization control switching unit is provided to switch from the first energization control to the second energization control even in the cruise area when predetermined conditions are satisfied when the first energization control is being executed in the cruise area, wherein a cruise state determination unit is provided to determine as a cruise state when the cruise area determination unit determines as the cruise area and additional conditions are satisfied, and wherein the predetermined condition is that the cruise state determination unit determines as the cruise state when the first energization control is being executed in the cruise area.

11. The ignition coil control device according to claim 10, wherein when the counter value of the integration counter reaches a lower limit value during the execution of the cooling process, the energization control unit terminates the cooling process.

12. The ignition coil control device according to claim 10, wherein a second predetermined time during which the integration counter is decremented is longer than a first predetermined time during which the integration counter is incremented.

13. The ignition coil control device according to claim 12, wherein when the driving area of the vehicle is determined as an idle area on the basis of the throttle opening and the engine speed, the integration counter decrements the integration counter every predetermined time shorter than the second predetermined time.

14. The ignition coil control device according to claim 10, wherein the predetermined condition is that the throttle opening is largely reduced when the first energization control is being executed in the cruise area.

15. The ignition coil control device according to claim 11, wherein a second predetermined time during which the integration counter is decremented is longer than a first predetermined time during which the integration counter is incremented.

16. The ignition coil control device according to claim 11, wherein the predetermined condition is that the throttle opening is largely reduced when the first energization control is being executed in the cruise area.

17. The ignition coil control device according to claim 12, wherein the predetermined condition is that the throttle opening is largely reduced when the first energization control is being executed in the cruise area.

18. The ignition coil control device according to claim 13, wherein the predetermined condition is that the throttle opening is largely reduced when the first energization control is being executed in the cruise area.

* * * * *